US005960682A

United States Patent [19]

Yamashita

[11] Patent Number: 5,960,682

[45] Date of Patent: Oct. 5, 1999

[54] PLUG WRENCH

[75] Inventor: Shoichiro Yamashita, Ogasa-gun, Japan

[73] Assignee: Ko-Ken Tool Co., Ltd., Ogasa-gun, Japan

[21] Appl. No.: 09/126,954

[22] Filed: Jul. 31, 1998

[30] Foreign Application Priority Data

Mar. 23, 1998 [JP] Japan ..... 10-074297

[51] Int. Cl.[6] ..... B25B 13/02

[52] U.S. Cl. ..... 81/125; 81/124.2; 81/121.1

[58] Field of Search ..... 81/125, 124.2, 81/121.1

[56] References Cited

U.S. PATENT DOCUMENTS

| | | | |
|---|---|---|---|
| 3,665,791 | 5/1972 | Carr | 81/125 |
| 3,745,861 | 7/1973 | Totsu et al. | 81/125 |
| 4,535,658 | 8/1985 | Molinari | 81/125 |
| 4,787,278 | 11/1988 | Bononi | 81/125 |
| 5,074,173 | 12/1991 | Cearley | 81/125 |
| 5,184,529 | 2/1993 | Matsubara et al. | 81/125 |
| 5,361,654 | 11/1994 | Rasipovits | 81/125 |
| 5,724,872 | 3/1998 | Shih | 81/125 |

*Primary Examiner*—David A. Scherbel
*Assistant Examiner*—Lee Wilson
*Attorney, Agent, or Firm*—Jacobson, Price, Holman & Stern PLLC

[57] ABSTRACT

The present invention provides a plug wrench in which a plug can be fitted securely to a wrench body and the plug is not damaged in fitting. The plug wrench comprises a concave fitting portion for inserting the plug in the cylindrical wrench body operated by a rotating handle, a fixing member made of a metal sheet fitted in the concave fitting portion, and a guide member with less hardness fitted on the bottom face of the fitting member.

4 Claims, 3 Drawing Sheets

PLUG WRENCH

BACKGROUND OF THE INVENTION

The present invention relates to a wrench for fixing a spark plug attached to an internal combustion engine.

For a conventional plug wrench using a magnet, in which a contact portion of plug is brought into contact with the short tubular magnet, the magnet is liable to be broken or cracked and there is a danger of a broken piece entering the engine because the magnet is hard and brittle. Also, if the plug is kept slightly apart from the magnet, the magnetic force for holding the plug is weak, so that the plug comes off from the plug wrench. Further, for a plug wrench of a type such that a cylindrical rubber is inserted in a wrench body and the spark plug is fixed by means of this cylindrical rubber, the rubber changes with passage of time, so that the plug wrench cannot be used for a long period of time.

SUMMARY OF THE INVENTION

An object of the present invention is to provide a plug wrench in which neither magnet nor rubber is used unlike the prior art, damage to a plug is prevented, there is no possibility of coming-off of plug, and no change occurs with passage of time unlike the plug wrench using rubber.

To achieve the above object, the present invention provides a plug wrench comprising a concave fitting portion, in which a plug is inserted, formed on the opposite side of a cylindrical wrench body provided with an operating portion to which a tip-end square portion of a rotating operation handle is fitted, a plug fixing member fitted in the concave fitting portion, which has a plurality of bent plate springs rising from the edge of a ring face attached to the bottom of the concave fitting portion and in contact with the peripheral surface thereof, and a guide member with less hardness than the plug such as brass, which is fitted on the bottom face of the concave fitting portion so that the plug comes into direct contact with the guide member.

BRIEF DESCRIPTION OF THE DRAWINGS

The drawings show a typical example of a plug wrench in accordance with the present invention.

DETAILED DESCRIPTION OF THE PREFERRED EMBODIMENT

Figure 1:
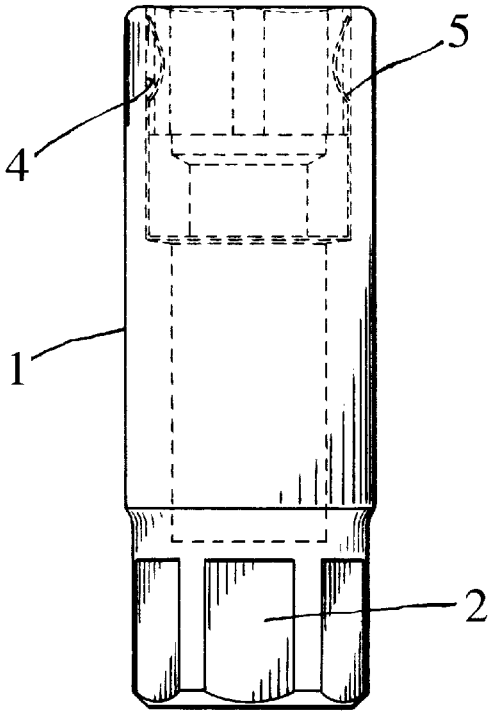
FIG. 1 is a front view of a plug wrench.
Figure 2:
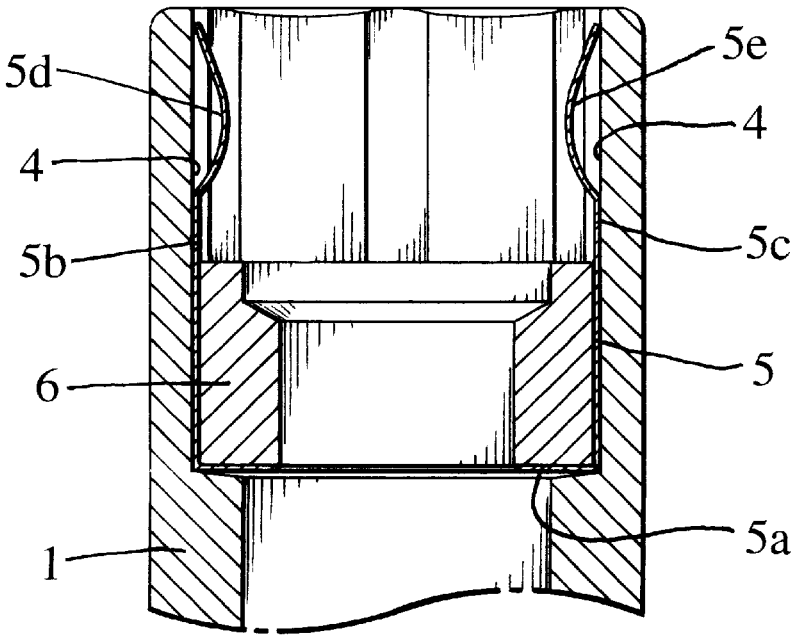
FIG. 2 is an enlarged sectional view of a principal portion thereof.

In the figures, reference numeral 1 denotes a cylindrical wrench body. At one end of the wrench body, a square operating portion 2 for a rotating operation handle (not shown) is provided, and at the other end thereof, a concave fitting portion 4 in which a plug 3 is inserted is formed, by which a fixing member 5 for the plug 3 is fitted onto the bottom of the concave fitting portion.

Figure 4:
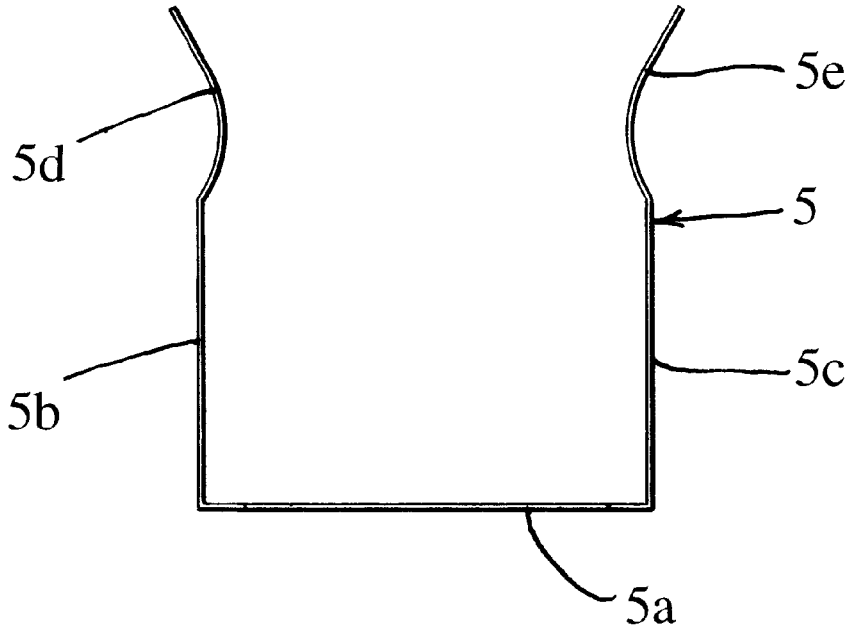
FIG. 4 is a front view of bent plate springs used for the plug wrench of the present invention.
Figure 5:
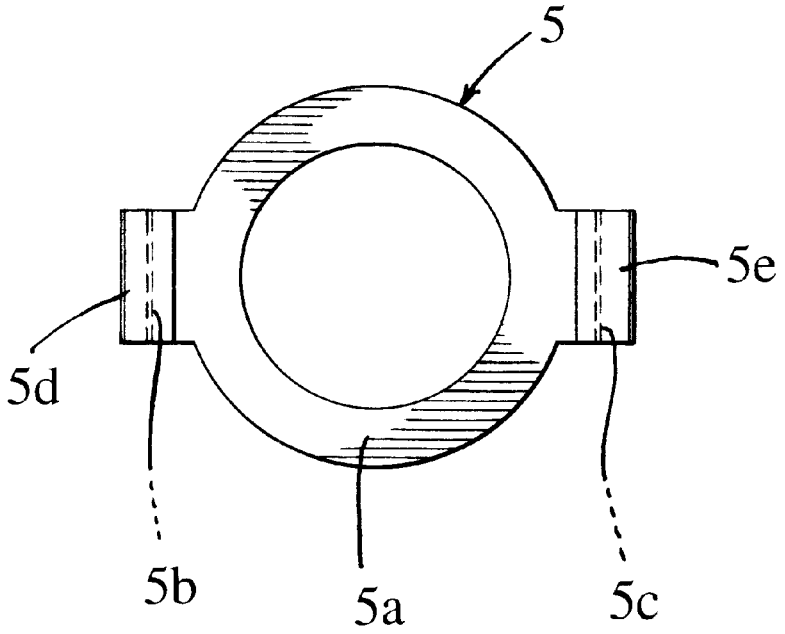
FIG. 5 is a plan view of the bent plate springs.

As shown in FIGS. 4 and 5, the fixing member 5 is made up of a ring face portion 5*a* and bent plate springs 5*b* and 5*c* rising at the right and left of the periphery thereof. The ring face portion 5*a* is brought into contact with the bottom of the concave fitting portion 4, and the bent plate springs 5*b* and 5*c* are made to touch at the peripheral wall of the concave fitting portion 4 so that elastic curved portions 5*d* and 5*e* are formed at the upper half portion. The bent plate spring may be provided at three places.

Reference numeral 6 denotes a brass guide member fitted onto the bottom face of the fixing member 5. A contact portion 3*a* of the plug 3 inserted in the wrench body 1 comes into direct contact with the guide member 6, so that the brass with less hardness accomplishes cushioning action, and the internal face of the guide member 6 serves as a guide for the plug 3.

Figure 3:
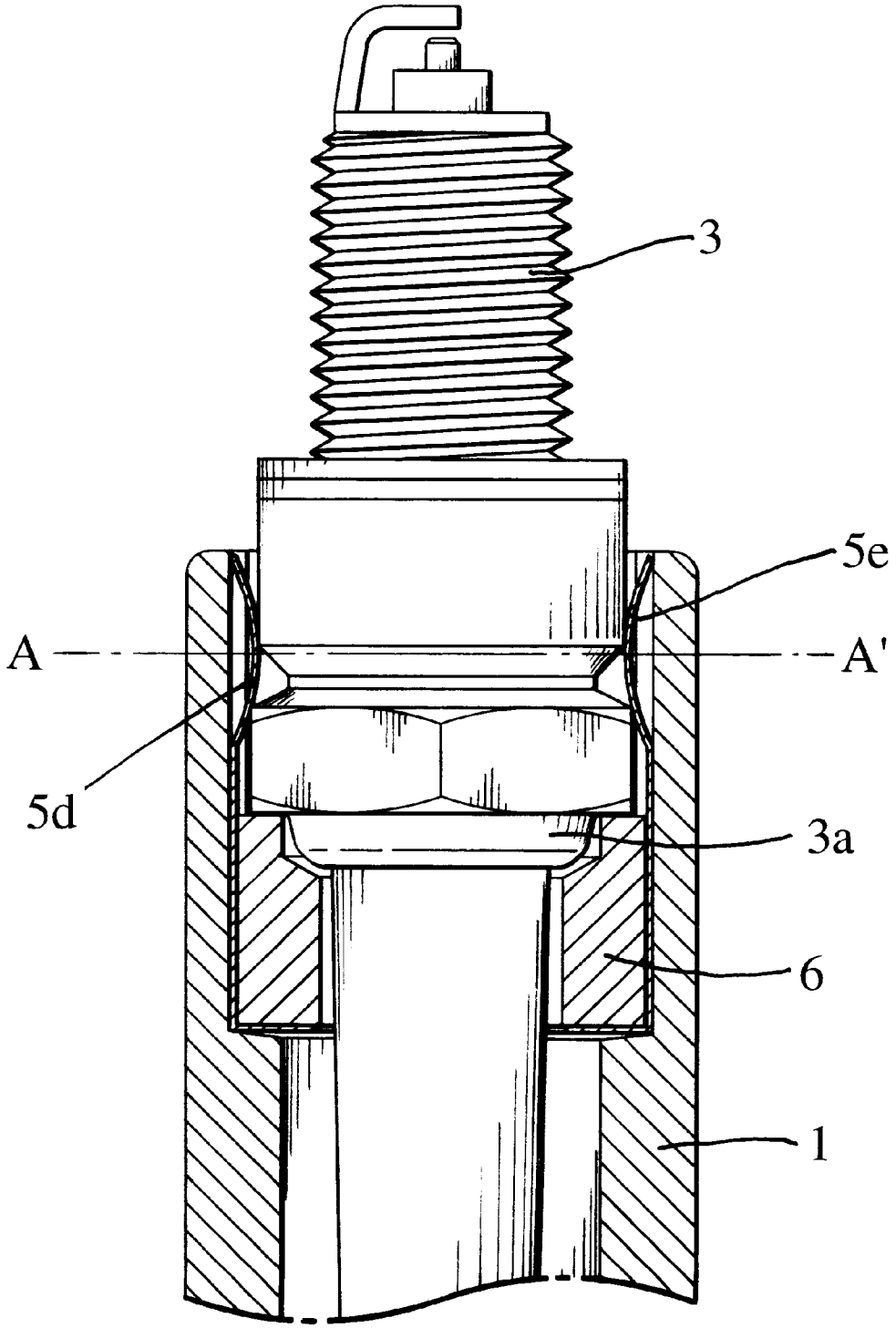
FIG. 3 is a sectional view of the principal portion in which a plug is inserted.

According to the present invention, when the plug is inserted in the wrench body 1, the plug is tightened by the bent plate springs at the portion beyond the line A-A' in FIG. 3, so that the plug holding force is increased, and the plug is installed securely. Also, a cushioning property is produced at the portion where the plug comes into direct contact with the guide member, so that the plug can be prevented from being damaged.

I claim:

1. A plug wrench comprising a concave fitting portion, in which a plug is inserted, formed on an opposite side of a cylindrical wrench body provided with an operating portion to which a tip-end square portion of a rotating operation handle is fitted, a fixing member made of a metal sheet fitted in said concave fitting portion, and a guide member with less hardness than said plug, which is fitted on a bottom face of said concave fitting portion so that said plug comes into direct contact with said guide member.

2. The plug wrench according to claim 1, wherein said fixing member made of a metal sheet comprises a ring face attached to said concave fitting portion and a plurality of bent plate springs which rise from an edge of said ring face and come into contact with a peripheral surface of said concave fitting portion.

3. The plug wrench according to claim 1, wherein said guide member is formed of brass.

4. A plug wrench comprising:

a concave fitting portion, in which a plug is inserted, formed on an opposite side of a cylindrical wrench body provided with an operating portion to which a tip-end square portion of a rotating operation handle is fitted;

a fixing member, made of a metal sheet fitted in said concave fitting portion, having a ring face attached to said concave fitting portion and a plurality of bent plate springs which rise from an edge of said ring face and come into contact with a peripheral surface of said concave fitting portion; and a brass guide member, which is fitted on a bottom face of said concave fitting portion so that said plug comes into direct contact with said guide member.

* * * * *